United States Patent [19]

Oppenlaender et al.

[11] 4,435,298

[45] Mar. 6, 1984

[54] AMMONIUM SALTS OF POLYMALEIC ACIDS, AND THEIR USE AS CORROSION INHIBITORS IN MINERAL OILS

[75] Inventors: Knut Oppenlaender, Ludwigshafen; Karl Stork, Lampertheim; Hans-Henning Vogel, Frankenthal; Erich Schwartz, Ludwigshafen; Claus P. Jakob, Viernheim, all of Fed. Rep. of Germany

[73] Assignee: BASF Aktiengesellschaft, Ludwigshafen, Fed. Rep. of Germany

[21] Appl. No.: 306,765

[22] Filed: Sep. 29, 1981

[30] Foreign Application Priority Data

Oct. 23, 1980 [DE] Fed. Rep. of Germany ..... 3039977

[51] Int. Cl.[3] ..... C10M 1/32; C01C 87/00; C10G 9/12

[52] U.S. Cl. ..... 252/34; 208/47; 525/327.6; 525/379; 260/501.1

[58] Field of Search ..... 252/389 A, 391, 392, 252/400 A, 402, 403, 34; 260/501.1; 208/47; 525/327.6, 379

[56] References Cited

U.S. PATENT DOCUMENTS

| | | | |
|---|---|---|---|
| 3,962,104 | 6/1976 | Swietlik et al. | 252/391 |
| 4,018,702 | 4/1977 | Boffardi et al. | 252/389 A |
| 4,079,012 | 3/1978 | Bosniack | 252/402 |
| 4,105,581 | 8/1978 | Sexsmith | 252/389 A |
| 4,260,724 | 4/1981 | Perner et al. | 526/229 |

FOREIGN PATENT DOCUMENTS

| | | | |
|---|---|---|---|
| 2806342 | 8/1978 | Fed. Rep. of Germany | 252/389 A |
| 1349769 | 4/1974 | United Kingdom | 252/389 A |

*Primary Examiner*—Natalie Trousof
*Assistant Examiner*—Raymond Covington
*Attorney, Agent, or Firm*—Oblon, Fisher, Spivak, McClelland & Maier

[57] ABSTRACT

Salts of polymaleic acids, having molecular weights of from 200 to 1,500, with amines, of the formula

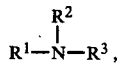

where $R^1$ and $R^2$ are identical or different and each is hydrogen, $C_9$–$C_{20}$-alkyl or $C_9$–$C_{20}$-alkenyl and $R^3$ is $C_9$–$C_{20}$-alkyl or $C_9$–$C_{20}$-alkenyl.

6 Claims, No Drawings

AMMONIUM SALTS OF POLYMALEIC ACIDS, AND THEIR USE AS CORROSION INHIBITORS IN MINERAL OILS

When mineral oils, gasoline fuels or diesel fuels come into contact with iron or iron-containing metals, there is always a problem of corrosion if condensation water is present. Such condensation water may contain acids, oxygen or hydrogen sulfide, all of which can cause substantial corrosion damage.

Oil-soluble substances have to be used as inhibitors against such corrosion. In addition to providing satisfactory protection, such substances should have little or no emulsifying action, so that the condensation water can still be separated off very rapidly.

Certain amides of long-chain fatty acids, especially of oleic acid, have hitherto been chiefly proposed for such purposes. Thus, for example, German Pat. No. 1,172,925 discloses reaction products of stearic or oleic acid and diethylenetriamine or similar alkylenepolyamines as corrosion inhibitors. These substances indeed have an anti-corrosion action in fuels or mineral oils, but they are powerful emulsifiers, and it was therefore necessary to use further additives which have a demulsifying action.

It is an object of the present invention to provide substances which exhibit both an extremely weak emulsifying action and extremely good anti-corrosion properties, and which are soluble in oils.

We have found that this object is achieved, according to the invention, by certain ammonium salts of low molecular weight polymaleic acids (oligomaleic acids).

The salts have the formula

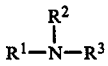

where $R^1$ and $R^2$ are identical or different and each is hydrogen, $C_9$–$C_{20}$-alkyl or $C_9$–$C_{20}$-alkenyl and $R^3$ is $C_9$–$C_{20}$-alkyl or $C_9$–$C_{20}$-alkenyl.

These compounds are thus salts of primary, secondary or tertiary amines of oligomaleic acids with molecular weights of from 200 to 1,500, alkyl or alkenyl in the amine each being of 9 to 20 C atoms. $C_{12}$–$C_{16}$-Alkylammonium salts, especially the mono- or di-alkylammonium salts, are particularly preferred, and monoisotridecylammonium salts are of especial industrial interest.

The oligomaleic acids on which the salts are based can be obtained by various prior art methods. British Pat. No. 1,349,769 discloses, for example, polymerization of maleic anhydride (MA) in an inert solvent in the presence of acetic anhydride and $H_2O_2$. A similar procedure is followed in German Laid-Open Application DOS No. 2,047,340, where, also, acetic anhydride and $H_2O_2$ are added to the polymerization batch. The procedure disclosed in German Laid-open application DOS 2,840,167, which is hereby incorporated by reference, is a preferred method, enabling hydrolyzed oligomaleic acid to be obtained from maleic anhydride in a single operation which, in contrast to the above processes, gives colorless products.

Maleic anhydride is dissolved in from 1 to 5 times the molar amount (from 100 to 500 mole percent—based on MA) of acetic anhydride, and from 0.2 to 0.5 times the molar amount (from 20 to 50 mole percent—based on MA) of $H_2O_2$, preferably in the form of a 30 to 50 percent strength aqueous solution, is added at from 80° to 140° C., preferably from 100° to 120° C., after which the reaction proceeds for from 1 to 8 hours at this temperature.

The $H_2O_2$ can be added all at once or gradually, and is preferably allowed to run slowly into the reaction batch in the course of from 1 to 5 hours at the above temperatures, with vigorous mechanical agitation.

It has proved advantageous to add small amounts (from 0.1 to 3 percent by weight, preferably from 0.1 to 2 percent by weight, based on MA) of an inorganic or organic acid to accelerate the reaction and to improve the yields and purity of the polymers. Such acids should be non-oxidizing, and examples are hydrochloric acid, sulfuric acid, orthoboric acid, p-toluenesulfonic acid, phosphoric acid, tartaric acid, citric acid and/or adipic acid.

The addition of reducing agents, and especially of reducing acids, in the same amounts as the above acids is similarly advantageous. Examples of suitable reducing agents are hydrazine, hydroxylamine and salts thereof, hydroquinone, pyrogallol and aldehydes, such as formaldehyde, acetaldehyde or glutarodialdehyde, and suitable reducing acids, which are preferred because they combine reducing power with an acid action, are hypophosphorous acid, phosphorous acid, sulfurous acid, aldehyde-acids, such as glyoxylic acid, phenolcarboxylic acids, such as salicylic acid, and sugar-acids, such as ascorbic acid. Oxalic acid can also successfully be employed as the reducing acid.

The salts according to the invention are obtained simply by mixing or neutralizing the resulting oligomaleic acid with one of the amines defined above, in an equivalent ratio of 1:1, until the pH is about 7. The salts scarcely have an emulsifying action, which is surprising in view of their solubility in oil and the presence of hydrophilic groups (polymaleate anions). We have found that if the number of carbon atoms in the amine component and the molecular weight of the polymaleic acids are above or below the values given, the properties in respect of emulsifying action deteriorate immediately. The products also have an excellent anti-corrosion action in mineral oils of all types, especially in lubricating oils, and in this respect are at least equivalent, and in many cases even superior, to the products of the prior art.

It is true that free polymaleic acids or simple salts thereof are known as corrosion inhibitors from U.S. Pat. Nos. 4,105,581 and 4,018,702 and from German Laid-Open Application DOS No. 2,806,342. However, these substances are effective only in purely aqueous systems, since they are not soluble in oils, and phosphates or phosphonates (U.S. Pat. No. 4,105,581 and German Laid-Open Application DOS No. 2,802,342) or zinc ions (U.S. Pat. No. 4,018,702) have to be added to achieve optimum results.

The salts according to the invention can be added to the mineral oils in amounts of from 100 to 10,000 ppm, preferably from 100 to 500 ppm, in undiluted form or as a solution in a solvent.

Examples of suitable solvents are aromatic hydrocarbons and aliphatic alcohols or alcohol mixtures of 6 to 12 C atoms.

Examples of mineral oils to which the corrosion inhibitors can be added are petroleum products, such as gas oil, gasoline, diesel fuels, heavy and light fuel oils and mineral oil lubricants.

The Examples which follow illustrate the invention.

EXAMPLES (a) Preparation of the oligomaleic acid

Starting materials 1,000 parts of maleic anhydride (MA)

1,400 parts of acetic anhydride 10 parts of $H_3PO_3$ 857 parts of 35% strength by weight aqueous $H_2O_2$ solution.

Procedure

The MA and the catalyst are dissolved, at room temperature, in acetic anhydride, in a reaction vessel with a reflux condenser, stirrer, dropping funnel and internal thermometer.

The 35% strength $H_2O_2$ is added dropwise at from 105° to 110° C. in the course of about 5 hours, with stirring. The solution becomes dark during this addition, but lightens again toward the end of the reaction. It is subsequently stirred for about another 2 hours at about 110° C. in order to bring the polymerization to completion.

The low-boiling constituents (water and acetic acid) are now distilled off, using a descending condenser, under about 30–75 mbar and at an internal temperature of 120° C., or the mixture is evaporated to dryness. The residue is then dried in a drying cabinet. Yield: quantitative, molecular weight: about 650

(b) Preparation of the salts

EXAMPLE 1

146.25 g (0.225 mole) of polymaleic acid are dissolved in 146.25 g of water, with stirring, and the solution is then brought to pH 7 with 320 g (1.61 moles) of mono-i-tridecylamine at 50°–60° C. and is stirred until the pH remains constant. Two phases are formed. The aqueous phase is separated off and discarded, and the organic phase is evaporated to dryness at 70° C. under a reduced pressure of about 20 mbar.

EXAMPLE 2

107.25 g (0.165 mole) of polymaleic acid are dissolved in 107.25 g of water, with stirring, and the solution is then brought to pH 7 with 402 g (1.056 moles) of di-tridecylamine at 50°–60° C. and is stirred until the pH remains constant. Two phases are formed. The aqueous phase is separated off and discarded, and the organic phase is evaporated to dryness at 70° C. under a reduced pressure of about 20 mbar.

EXAMPLE 3

65 g (0.1 mole) of polymaleic acid are dissolved in 65 g of water. 207 g of a $C_8$–$C_{12}$-alcohol mixture (oxo-oil) are then added, and 142 g (0.715 mole) of mono-i-tridecylamine are added dropwise, the pH reaching about 7. After the mixture has been stirred at from 70° to 80° C. for one hour, the water is removed by distillation at 70° C. under 20 mbar.

Performance tests

The action of the polymaleates was tested by 3 methods:

1. Humidity chamber corrosion test in accordance with DIN 51,359

Steel sheets of a particular composition are immersed in the sample and left in a humidity chamber at a particular temperature for 200 hours. After this period, the sheets are evaluated visually (see Table), and their change in weight is also determined.

TABLE 1

| Product | Weight loss | Visual evaluation |
|---|---|---|
| without additive | −154 mg | 4 |
| Containing the product of Example 1 | −0.7 mg | 1 |

2. Interface corrosion test a) With condensation water

Increasing amounts of the inhibitor to be tested are added to 100 ml portions of test oil and each mixture is poured over a layer of 100 ml of condensation water. The prepared, weighted test strips are wetted in the inhibitor-containing test oil by slow stirring, and are then dipped into the aqueous phase. Half of each strip is thus in the aqueous phase.

Test temperature: 20° to 25° C.

Test period: 18 days

The cleaned test strips are then weighed, and evaluated by comparison with a blank.

(b) With hydrogen sulfide

The experiments are carried out as described under (a), except that $H_2S$ is first passed into the test liquids (bubbling through for 30 minutes).

Test oil: saturated with $H_2S$

Condensation water: saturated with $H_2S$

Test temperature: 20° to 25° C.

Test period: 8 days

The strips are evaluated as described under (a).

TABLE 2

| Product | Dosage (ppm) | Test method | Weight loss (mg) |
|---|---|---|---|
| Blank value | — | a | 26 |
| Diamide derived from oleic acid and diethylenetriamine-diamide | 50 | a | 0.9 |
| | 100 | a | 1.2 |
| Product of Example 1 | 50 | a | 0.6 |
| | 100 | a | 1.1 |
| | 200 | a | 1.1 |
| Blank value | — | b | 81 |
| Diamide derived from oleic acid and diethylenetriamine-diamide | 200 | b | 5 |
| Product of of Example 1 | 200 | b | 1.3 |

This test especially shows the improved anticorrosion effect of the product according to the invention against water containing $H_2S$.

3. Emulsion test in accordance with DIN 51,415

Additive-containing fuels (gasoline) are poured over layers of standard buffer solution (pH 6.85) in 100 ml measuring cylinders and the cylinders are shaken thoroughly for 2 minutes. After 5 or 10 minutes, the mixtures are evaluated visually in accordance with DIN No. 51,415. The emulsion (intermediate phase) can be recorded in ml.

The separating layer formed is rated as follows (DIN No. 51,415):

1 clear and pure 1b small, clear bubbles 2 slight streaking 3 moderate streaking 4 dense streaking with much foam

TABLE 3

| Product | Dosage (ppm) | Evaluation after 5 minutes | ml of emulsion after 5 minutes | Evaluation after 10 minutes | ml of emulsion after 10 minutes |
|---|---|---|---|---|---|
| Blank value | — | — | — | — | — |
| Diamide derived from oleic acid and diethylenetriamine-diamide | 100 | 4 | 30 | 4 | 22 |
| Product of Example 1 | 100 | 4 | 1 | 1b | 0 |

We claim:

1. An ammonium salt having an equivalents ratio of 1:1 of a polymaleic acid having a molecular weight of from 200 to 1,500 and an amine component, of the formula $$R^1-\overset{\overset{\displaystyle R^2}{|}}{N}-R^3$$

where $R^1$ and $R^2$ are identical or different and are hydrogen, $C_9$–$C_{20}$-alkyl or $C_9$–$C_{20}$-alkenyl and $R^3$ is $C_9$–$C_{20}$-alkyl or $C_9$–$C_{20}$-alkenyl.

2. A corrosion inhibitor for a mineral oil, consisting of an ammonium salt of a polymaleic acid as claimed in claim 1.

3. The corrosion inhibitor of claim 2 wherein said salt is dissolved in a compatible solvent selected from the group consisting of an aromatic hydrocarbon, aliphatic alcohol or mixtures thereof.

4. A corrosion inhibited mineral oil consisting essentially of a mineral oil containing from 100 to 10,000 ppm of the ammonium salt of polymaleic acid of claim 1.

5. An ammonium salt having an equivalent ratio of 1:1 of a (1) polymaleic acid having a molecular weight of from 200 to 1,500 obtained by polymerizing maleic anhydride in from 1 to 5 moles of acetic anhydride per mole of maleic anhydride, in the presence of from 0.2 to 0.5 mole of hydrogen peroxide per mole of maleic anhydride, at from 80° to 140° C., (2) and an amine component of the formula $$R^1-\overset{\overset{\displaystyle R^2}{|}}{N}-R^3$$

where $R^1$ and $R^2$ are identical or different and are hydrogen, $C_9$–$C_{20}$-alkyl or $C_9$–$C_{20}$-alkenyl and $R^3$ is $C_9$–$C_{20}$-alkyl or $C_9$–$C_{20}$-alkenyl.

6. A corrosion inhibited mineral oil consisting essentially of a mineral oil containing from 100 to 10,000 ppm of the ammonium salt of polymaleic acid of claim 5.

* * * * *